US005555000A

United States Patent [19]

Sarrasin et al.

[11] Patent Number: 5,555,000

[45] Date of Patent: Sep. 10, 1996

[54] PROCESS AND DEVICE FOR THE CONTROL OF A MICROTIP FLUORESCENT DISPLAY

[75] Inventors: Denis Sarrasin, Sassenage; Michel Garcia, Les Milles, both of France

[73] Assignees: Commissariat a l'Energie Atomique, Paris; Pixel International S.A., Rousset, both of France

[21] Appl. No.: 278,329

[22] Filed: Jul. 21, 1994

[30] Foreign Application Priority Data

Jul. 22, 1993 [FR] France ..... 93 09022

[51] Int. Cl.[6] ..... G09G 3/12

[52] U.S. Cl. ..... 345/75; 345/147

[58] Field of Search ..... 345/75, 147, 148, 345/149, 89, 58, 63, 77, 211

[56] References Cited

U.S. PATENT DOCUMENTS

| | | | |
|---|---|---|---|
| 5,075,683 | 12/1991 | Ghis | 345/149 |
| 5,196,738 | 3/1993 | Takahara et al. | 345/89 |
| 5,250,937 | 10/1993 | Kikuo et al. | 345/89 |
| 5,343,221 | 8/1994 | Arakawa et al. | 345/211 |
| 5,363,118 | 11/1994 | Okumura | 345/89 |

FOREIGN PATENT DOCUMENTS

| | | |
|---|---|---|
| 0478386 | 4/1992 | European Pat. Off. . |
| 0479450 | 4/1992 | European Pat. Off. . |

OTHER PUBLICATIONS

Electronic Circuits Discrete and Integrated, Donald L. Schilling, 1979, pp. 706 and 712–712.

*Primary Examiner*—Richard Hjerpe
*Assistant Examiner*—Doom Chow
*Attorney, Agent, or Firm*—Oblon, Spivak, McClelland, Maier, & Neustadt, P.C.

[57] ABSTRACT

A device and a process for the control of a microtip fluorescent screen or display formed from pixels arranged in accordance with L rows and M columns of images able to have a discrete number of Q grey tones, in which the column voltage values are chosen in a strictly increasing sequence of N+1 values such that the row selection time being subdivided into S equal time intervals Δt, each voltage value is applied an integral number of times Δt, (N×S)+1 representing the number of grey levels, with N≧2 and S≧2. During a row selection time, the corresponding column voltage assumes a first value Va during a certain number of time intervals Δt, then during the remaining time intervals it additionally has a second value Vb following onto the first in the sequence of N voltages.

10 Claims, 4 Drawing Sheets

PROCESS AND DEVICE FOR THE CONTROL OF A MICROTIP FLUORESCENT DISPLAY

DESCRIPTION

1. Technical Field

The present invention relates to a process and a device for the control of a matrix display for displaying images having different grey levels, of the microtip fluorescent display type. As the images can be in black and white or in color, in the latter case the term "grey level" stands for "color half-tones".

2. Prior Art

Microtip fluorescent screens or displays are known and are in particular described by R. Meyer in the article entitled "Microtip Fluorescent Display" (Japan Display, 86, p 512).

It is known that for the control of the display of images on a matrix display, use is generally made of a "one row at a time" addressing principle. The addressing of a microtip display having L rows and M columns consequently takes place row by row (row time=$T_L$) during a frame of duration $T_T$ exceeding or equal to L×T . During the addressing of each row, the informations to be displayed on the M pixels of said row are simultaneously applied to the M display columns.

An article by T. Leroux, A. Ghis, R. Meyer and D. Sarrasin entitled "Microtips Display Addressing" (SID 91 Digest, pp 437 to 439) contains a description of the operating principle of such displays, as well as the different ways of addressing them. This article makes a distinction between two addressing types:

an analog addressing consisting of sampling, after amplification, an analog source signal and transferring to the column in question a voltage directly proportional to the video signal, a digital addressing in Pulse Width Modulation (PWM) consisting of switching a so-called on voltage for a time longer or shorter than the row selection time $T_L$, as a function of the grey level to be displayed, as described in French patent application FR-A-88 08756 of 29.6.1988.

There are also variants of solutions of the digital type. Firstly there is a Frame Rate Control or FRC. This method is in particular described in EP-A-384 403 and EP-A-364 307 in the case of STN displays (multiplexed LCD's) and consists of carrying out several scans of the image successively allocating on or off states to the same image elements, the eye serving as the integrator. There is also a method using multilevel circuits. This method consists of using circuits able to switch N different voltage levels (in practice N=8 or N=16). To each voltage corresponds a given grey level. This method also uses eight level circuits on two frames, which makes it possible to obtain with the same voltages and durations, sixteen grey levels, as described in the article by H. Mano, T. Furuhashi and T. Tanaka entitled "Multicolor Display Method for TFT-LCD" (SID 91 Digest, pp 547 to 550).

It is also possible to use eight level circuits on two successive frames, but allocating a different significance to the frames by means of voltages. The first frame e.g. supplying the low orders (0, 1, 2, 3, 4, 5, 6, 7) and the second the high orders (0, 8, 16, 24, 32, 40, 48, 56), which makes it possible to obtain sixty four grey levels, as described in the article by K. Takahara, T. Yamaguchi, M. Oda, H. Yamaguchi and M. Okabe entitled "16-Level-Gray-Scale Driver Architecture and Full-Color Driving for TFT-LCD" (IDRC 91 Digest, pp 115 to 118). However, this method limits the screen contrast.

Nowadays, in the world of flat screens, competition has been established around a few key points. One of them is a search for low consumption levels. Two of the described addressing variants for the display of grey levels are more interesting from the screen capacitive consumption standpoint, namely the analog control and the method using multilevel circuits, which is in practice limited to sixteen voltage levels.

The practical performance of the analog control with circuits functioning in linear form leads to a difficult compromise. Thus, in such an operation, if the display has a very low consumption, it is necessary to supply a non-negligible current in order to polarize the output stage of the circuits. In addition, the more it is wished to have short-times for passing from one level to another (corresponding to the addressing of two successive rows) the more it is necessary to increase said current and therefore the consumption of the control electronics.

Digital circuits have the interest of a very low consumption, because they function as switches, without requiring a polarizing current and with very short response times. The method using multilevel circuits comes close to the ideal solution, but if it is wished to display Q=256 grey tones, it is clearly impossible to envisage a circuit having 256 voltage inputs and the same number of 256 channel analog multiplexers as outputs to be driven.

Another prior art document, namely EP-A-478 386 applies to Thin Film Transistor or TFT displays. In the proposed control method, the aim is to obtain on the considered column control electrode, at the end of the row selection time, a column voltage determined by the data supplied by the source. According to the prior art a voltage chosen from among N external voltages is switched, said application proposing a means for obtaining a large number of different final voltages on the basis of a restricted number of external voltage sources. The principle consists of charging the column with the external voltage which is available and below or equal to, but as close as possible to the desired final value and then, when the first voltage is established and at a time dependent on the desired final voltage (and therefore the grey level to be displayed), the immediately higher, available external voltage. As the passage to said voltage takes place with a certain time constant linked with the capacitance of the column and the access resistance to said capacitance, the stored voltage on the capacitance being that obtained at the end of the row time (Rq: in a TFT display, each pixel is linked with a column electrode across a transistor operating as a switch and which is driven by the row electrode and at the end of the row time said switch is opened, so that there is a high impedance passage to the pixel capacitance and the storage of the voltage thereon). By acting on the time of tripping the second voltage, at the end of selection it is possible to obtain a complete series of intermediate voltages.

The invention aims at proposing a process and a device for the control of a matrix display of the microtip fluorescent display type making it possible to solve the different problems referred to hereinbefore.

DESCRIPTION OF THE INVENTION

The invention therefore relates to a process for the control of a microtip fluorescent display formed from pixels arranged in accordance with L rows and M columns of images which can have a discrete number of Q grey tones, said process comprising, at each selection of a row of the display during a row selection time $T_L$, the simultaneous application to the display columns of voltages corresponding to the grey levels to be displayed at the image points corresponding to the intersection of said row and said columns, wherein the different column voltage values applicable to the columns are chosen in a strictly increasing sequence of N+1 values such that the row selection time is subdivided into S equal time intervals Δt, each voltage value being applied an integral number of time Δt, (N×S)+1 representing the number Q of grey levels, with N≧2 and S≧2, and in that during the row selection $T_L$ and as a function of the grey level to be displayed at an image point, the corresponding column voltage assumes a first value Va for a certain number of time intervals Δt, and then, if need be, during the remaining time intervals at the most one second value Vb, said second value following on to the first in the sequence of N voltages.

In this process use is made of an addressing method having both time and voltage modulation possibilities offered by the electro-optical response of microtip fluorescent displays. Beyond the emission threshold, the brightness obtained is an effect proportional to (V×T), V being the cathode gate voltage applied and T the duration of the application of said voltage. As a result of the present invention, there is a combination of the advantages of the consumption of digital circuits and the analog addressing method, while permitting the selection of a large number of grey levels.

The invention also relates to a device for controlling the columns of a microtip fluorescent display making it possible to display grey levels comprising a digital data source supplying words K encoding the information to be displayed on k bits, a display controller receiving synchronization signals from the data source and controlling the different signals able to drive the control circuits of the display columns, a generator of (N+1) discrete voltages, the control circuits for the display columns incorporating a shift register with k inputs and k×M outputs, each output being associated with a storage flip-flop and analog multiplexing means connected on the one hand to the k×M flip-flops and to the generator and on the other to the M columns, said means making it possible to switch to each column a voltage chosen from among N+1 as a function of the word K stored in the k flip-flops associated with said column.

Each word K stored in the k flip-flops of a control circuit of a column is subdivided into two words H and B such that the word H is constituted by the h most significant bits of K with $2^h$=N+1 and such that the word B is constituted by the (k–h) remaining least significant bits, the multiplexing means of the control circuit of a column comprising a binary decoding circuit of n bits 1 from among $2^n$ connected to the h flip-flops of said column having in the memory the h most significant bits, said circuit producing N signals $H_0$ to $H_{N-1}$ translating the coding of H and making it possible to select the pair of column voltages ($V_i$, $V_{i+1}$) adapted to the grey level to be displayed, a comparator connected to the (k–h) least significant bits and with a sequencer able to supply the addressing sequence within a row time coded on (k–h) bits, a combinatorial logic circuit connected to the outputs of the decoding circuit and to the comparator, N+1 analog switches, whose analog inputs are connected to the generator and the validation inputs to the combinatorial logic circuit and whereof all the outputs are connected to the corresponding column.

The sequencer supplies the index P of the addressing sequence within a row time, said index P being coded on (k–h) bits. This sequencer is advantageously a counter, whose clock has $2^{(k-h)}$ pulses per row time, said counter being initialized for each row time. The comparator performs the comparison between the signals P and B and supplies a coding bit E such that:

$$P<B \Rightarrow E=1$$

$$P \geqq B \Rightarrow E=0.$$

The combinatorial logic circuit between the coding bit E and the signals $H_0$ to $H_{N-1}$ makes it possible to obtain the signals $F_0$ to $F_N$ driving the N+1 analog switches, such that:

$$F_0=\bar{E}\cdot H_0$$

$$F_1=E\cdot H_o+\bar{E}\cdot H_1$$

$$F_i=E\cdot H_{i-1}+\bar{E}\cdot H_i$$

$$F_{N-1}=E\cdot H_{N-2}+\bar{E}\cdot H_{N-1}$$

$$F_N=E\cdot H_{N-1}$$

so as to position in time the voltage change Vi to Vi+1.

The generator of N+1 discrete voltages can be constituted by operational amplifiers connected as following amplifiers, with input voltages fixed by a resistive divider bridge (R1, R2, . . . RN). In the case of a linear distribution of the voltages, the resistances all have the same value.

The generator of N+1 discrete voltages can also be based on one or more digital-analog converters, which are themselves driven by a controller responsible for calculating the values of the N+1 voltages.

A black and white or color palette circuit can also make it possible to control the generator of discrete voltages in the manner required by the user.

DETAILED DESCRIPTION OF EMBODIMENTS

The invention relates to a process for the control of a microtip fluorescent display formed from pixels arranged in accordance with L rows and M columns of images which can have a discrete number of grey tones.

In this process, the columns (cathodes) are controlled by the signals used for activating them. These column signals permit the selection of a voltage Vi from among N+1 with N≧2 and O≦i≦N. These N+1 voltages Vi are chosen such that their values form a strictly increasing sequence. The row time is subdivided into S equal time intervals Δt, S being an integer with S≧2. This leads to a squaring or chequering of the time-voltage space with Q=S×N boxes or squares, each of them representing a brightness supply proportional to its significance V×T.

During a row selection time $T_L$ and as a function of the grey level to be displayed, the column signal must assume a first voltage value Va for a certain number of time intervals Δt and then, if need be, during the remaining time intervals, at the most one second voltage value Vb, which follows on to the first in the sequence of N voltages. This second value must be such that:

$$Vb=Va\pm\Delta V$$

If the order 1 grey tone is obtained by the application of a voltage V1 for a time Δt, the order 2 grey tone will be obtained by the application of the voltage V1 during a time Δt+Δt, and for obtaining the order S grey tone it is necessary to apply it for S times the time Δt. The order (S+1) grey tone will be obtained by applying a voltage V2 for a time Δt and the voltage V1 for the (S−1) other time intervals.

Figure 1:
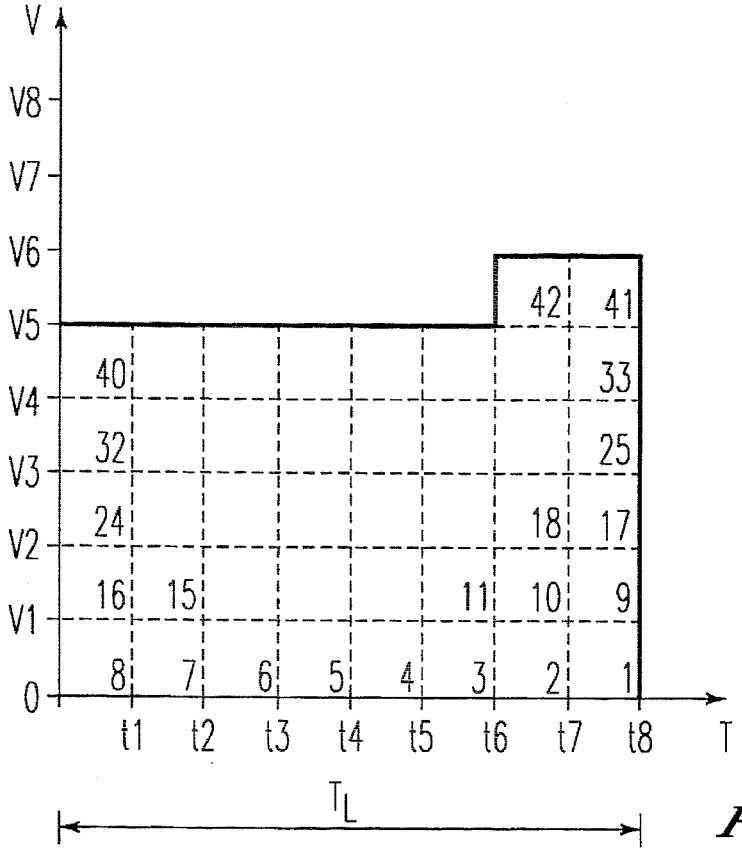
FIG. 1 shows an example of a signal for activating the columns of a matrix display.

FIG. 1 gives an example of a signal for activating the columns of a matrix display in the case N=8 and S=8 making it possible to generate N×S=8×8=64 grey levels. The signal corresponds to the display of grey No. 42, i.e. the activation of squares 1 to 42 in the drawing. Compared with a conventional control operating in multilevels, it is possible to obtain a large number of grey levels e.g. 256 with pairs {N=16 and S=16} or {N=8 and S=32}, while having a single supplementary transition between two adjacent levels ($\Delta V=V_N/N$ in the particular case of a linear voltage sequence), so that the consumption "cost" is at a minimum, because the capacitive consumption of a transition is proportional to the square of the voltage shift ΔV.

Figure 2:
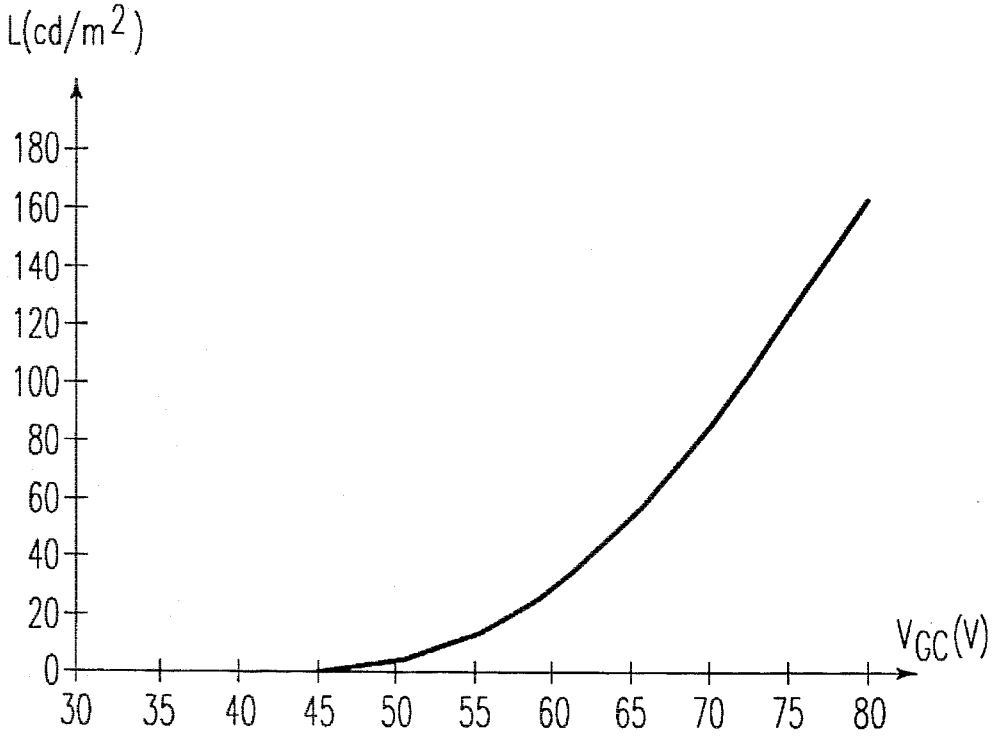
FIG. 2 shows the brightness/voltage response of a microtip fluorescent display.

The N+1 voltages Vi can e.g. be such that for i from O to N: $Vi=ix(V_N/N)$, which gives the same significance ΔVx Δt to each shift between consecutive grey levels. However, it is advantageously possible to choose a non-linear distribution by differently graduating the voltages, which makes it possible to adjust the electro-optical response of the display in accordance with the wishes of the user. Thus, the brightness/voltage response (row/column or grid/cathode $V_{GC}$) of a microtip fluorescent display is in accordance with FIG. 2, so that by using equal time intervals and appropriately chosen voltages, it is possible to bring about correspondence in successive ranges between said response and the desired curve.

In order to obtain a given sequence of brightness values, it is possible to find a single sequence of voltages on the basis of a brightness/voltage response curve. Thus, it is possible to carry out a gamma correction for television application or fulfil the function of a palette circuit for data processing-type applications.

Unlike in the case of the aforementioned EP-A-478 386, the process according to the invention is applicable to the particular case of microtip screens or displays. The electrooptical response of said displays differs from that of active matrix liquid crystal displays (TFT). Thus, for a TFT-type display, for a row time charging takes place of a voltage, which is then maintained on the pixel throughout a frame (complete scan of the image), said voltage driving the switching of the molecules and therefore the modulation of the light transmitted during the complete frame. For a microtip display, the electro-optical response takes place immediately during the row selection time and the considered pixel only emits during this row time.

The voltage applied to a selected row brings the column/row voltage to the limit of the emission threshold (whereas the column/row voltage for an unselected row is still below said threshold). Moreover, the voltage applied to a column during this row selection time immediately brings about a more or less pronounced emission (as a function of the brightness/voltage curve). Therefore emission only takes place during the row selection time.

The process according to the invention is based on said feature for proposing a constriction of the grey levels per square. Diagrammatically, within a row selection time, the control possibilities of a pixel are represented by the area of a rectangle having a side of dimension V (column voltage= cathode voltage) and a side of dimension $T_L$. The proposal is to carry out a squaring of said area with S equal time intervals for the side $T_L$ and N equal or non-equal voltage intervals for the side V. In the same way as for EP-A-478 386, practice limits the discrete number of external voltages Vi which can be used, so that there is a squaring of S×N squares or boxes. It is therefore possible to obtain Q=(S×N)+1 grey levels (from 0to Q−1) by the simultaneous selection of 0, 1, 2 or (Q−1) squares.

The selection of a plurality of said squares must take place in a clearly defined order on the one hand because the voltages are not necessarily equal, so that the respective significance of each square is dependent on its voltage level (a random selection of these squares would lead to discontinuities on the response curve) and on the other hand because the first objective of the addressing system according to the invention is to minimize the transitions on the applied column voltages (capacitive consumption aspect). It is therefore appropriate to add squares along the $T_L$ axis before passing to higher order squares along the V axis. In practice this leads to the display of a given grey level, by the selection of a first voltage $V_i$ during (S−j) time intervals and then the selection of a second voltage $V_i+1$ (or $V_i-1$) during the j other time intervals of the row in question.

Thus, the process according to the invention digitizes the column voltage/row selection time space by subdividing said time into S, previously defined equal time intervals in such a way that the switching between two selected voltages can take place at the start of any random interval. In EP-A-478 386, in the control of the columns there is a switching between two adjacent voltages from a generator. However, as said switching aims at storing on the capacitor of a pixel, of an intermediate voltage to the two selected voltages, said intermediate voltage is obtained by using the charging time of said capacitor across its control transistor by acting on the charge starting time. Moreover, unlike in the invention, the switching between the two selected voltages takes place at the end of the row selection time.

Figure 3A:
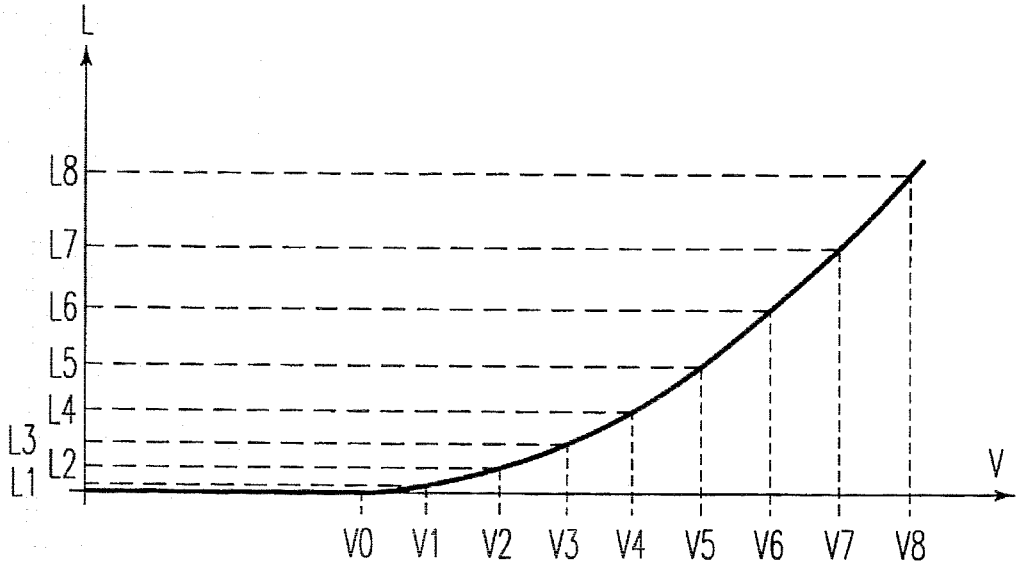
FIGS. 3A and 3B show the distribution of the brightness as a function of the voltage.
Figure 3B:
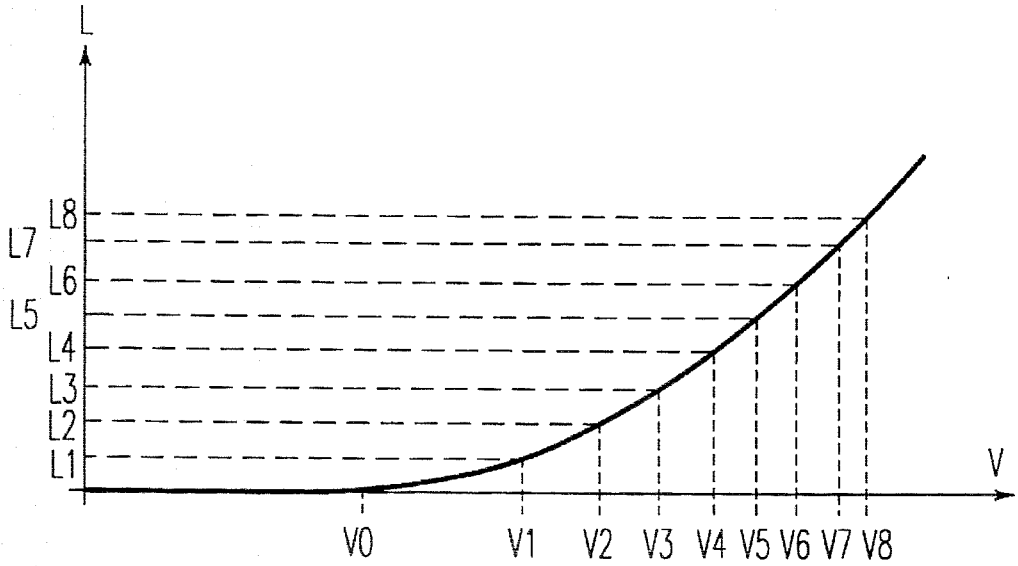

FIGS. 3A and 3B provide a better understanding of the possibility of regulating the shifts or variations between the N voltages. FIG. 3A shows the distribution of the brightnesses L obtained in the case of equal voltage shifts V. FIG. 3B shows a linear distribution of the brightnesses L obtained by adjusting said voltages V.

Figure 4:
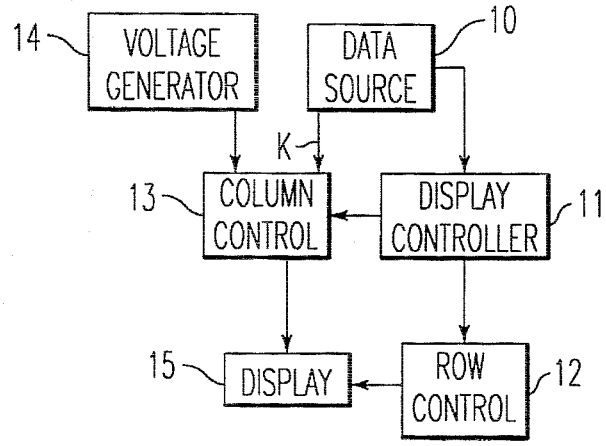
FIGS. 4 and 5 illustrate the device according to the invention.

The invention also relates to an electronic control device for the display columns. As shown in FIG. 4, said device comprises:

a digital data source 10 supplying words K encoding the information to be displayed on k bits (in the case of an analog source, it is necessary to carry out an analog-digital conversion of the data), a display controller 11 receiving synchronization signals from the data source and controlling the different signals for driving the control circuits 13 of the columns of the display 15, a generator 14 of N+1 discrete voltages, the control circuits 13 of the columns of the display 15, the controller 11 also being used for driving the row control circuits 12.

Figure 5:
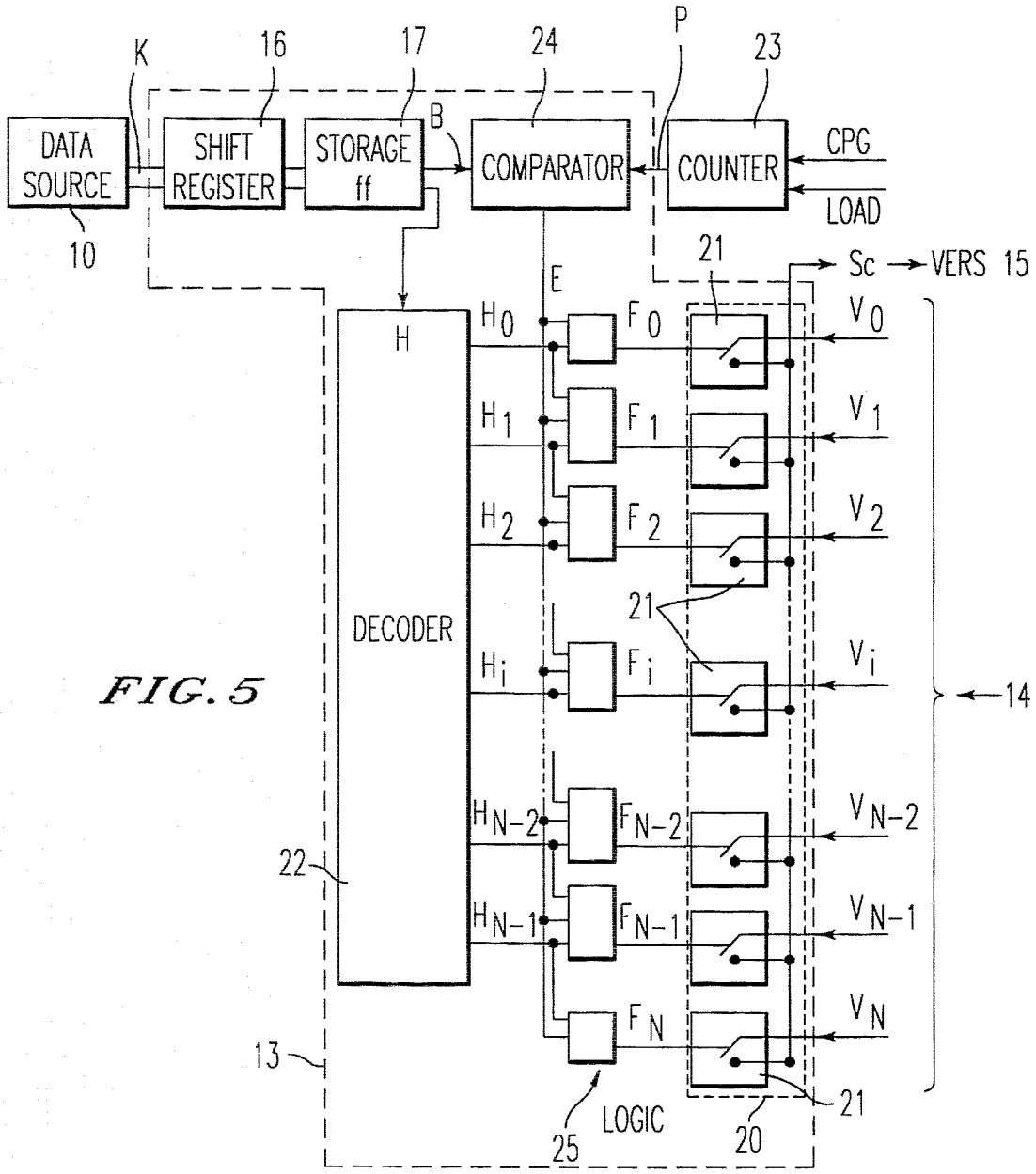

The display column control circuits 13 are conventionally constituted by a shift register 16 having k inputs and k×M outputs, each output being associated with a storage flip-flop 17. In other words, each column control circuit has part of the shift register and k flip-flops. Each word K stored in this way in the k flip-flops of a column control circuit must be able to validate the control of a voltage chosen from among N+1. Thus, the control circuit comprises multiplexing means. The original part of the device relates to these means. FIG. 5 illustrates the formation of the multiplexing means according to the invention. These means comprise a N bit binary decoding circuit 22 (1 among $2^n$), a comparator 24, a combinatorial logic circuit 25 and N+1 analog switches 21, all of whose outputs are connected to the column output Sc of the channel in question and the analog inputs are connected to the generator 14. The validation inputs of these switches are determined in the manner described hereinafter.

The word K supplied by the source 10 is subdivided into two words H and B such that on having N+1 voltages, the word H is constituted by h high order bits K, with $2^h$=N+1, the word B being constituted by the (k–h) remaining low order bits.

On considering e.g. the binary word K: 11001110 for N=8, we have h=3 and the word H will be constituted by the three first bits, i.e.: 110 and the word B by the five last bits, i.e.: 01110. The word H is used for determining the pair of voltages (Vi, Vi+1) appropriate for the grey level to be displayed and supplies the N bits 1 from among $2^n$ binary decoding circuit 22 in order to produce the N signals $H_0$ to $H_{N-1}$ translating the encoding of H.

Thus, e.g. the following truth table of a three bit (1 among 8) ($2^3$=8) binary decoder is obtained.

| inputs | | | outputs | | | | | | | |
|---|---|---|---|---|---|---|---|---|---|---|
| $h_2$ | $h_1$ | $h_0$ | $H_0$ | $H_1$ | $H_2$ | $H_3$ | $H_4$ | $H_5$ | $H_6$ | $H_7$ |
| 0 | 0 | 0 | 1 | 0 | 0 | 0 | 0 | 0 | 0 | 0 |
| 0 | 0 | 1 | 0 | 1 | 0 | 0 | 0 | 0 | 0 | 0 |
| 0 | 1 | 0 | 0 | 0 | 1 | 0 | 0 | 0 | 0 | 0 |
| 0 | 1 | 1 | 0 | 0 | 0 | 1 | 0 | 0 | 0 | 0 |
| 1 | 0 | 0 | 0 | 0 | 0 | 0 | 1 | 0 | 0 | 0 |
| 1 | 0 | 1 | 0 | 0 | 0 | 0 | 0 | 1 | 0 | 0 |
| 1 | 1 | 0 | 0 | 0 | 0 | 0 | 0 | 0 | 1 | 0 |
| 1 | 1 | 1 | 0 | 0 | 0 | 0 | 0 | 0 | 0 | 1 |

This example is given for a positive logic-functioning decoder (active output at state 1). It is also possible to operate with a negative logic-operating decoder, the important thing is that there is only a single valid output at once, so as to only have one switch closed at a given time.

For this purpose the sequencer is provided and supplies the index P of the addressing sequence within the row time, P being coded on (k–h) bits. This sequencer can e.g. be a counter 23, whose clock CPG has $2^{(k-h)}$ pulses per row time, said counter 23 being initiated for each row time (load signal). The counter 23 can be an external counter or a counter per circuit. Thus E is a coding bit, the comparator 24 making it possible to carry out the comparison of B and P such that:

$$P<B \Rightarrow E=1$$

$$P \geqq B \Rightarrow E=0.$$

This coding bit E supplied the comparator 24 makes it possible to position in time the passage of Vi to Vi+1. The combinatorial logic circuit 25 between the signal E and the signals $H_0$ to $H_{N-1}$ makes it possible to obtain the signals $F_O$ to $F_N$, which drive the N+1 analog switches and we obtain:

$$F_0=\bar{E}\cdot H_0$$

$$F_1=E\cdot H_o+\bar{E}\cdot H_1$$

$$F_i=E\cdot H_{i-1}+\bar{E}\cdot H_i$$

$$F_{N-1}=E\cdot H_{N-2}+\bar{E}\cdot H_{N-1}$$

$$F_N=E\cdot H_{N-1}$$

Figure 6:
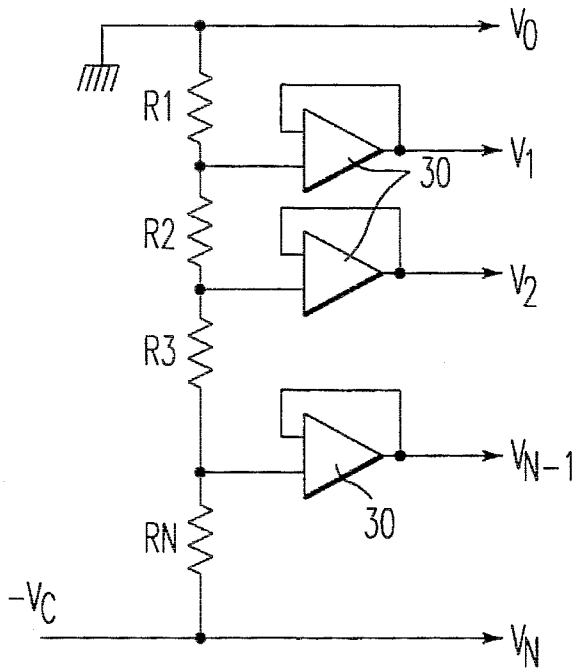
FIGS. 6 and 7 illustrate embodiments of the circuit of the device according to the invention.

As shown in FIG. 6, the generator 14 of N+1 discreet voltages can e.g. be constituted by N+1 operational amplifiers 30 connected as followers, with input voltages fixed by a resistive dividing bridge R1, R2, . . . RN. In the particular case of FIG. 6, where the supply terminals of the divider bridge are themselves voltage sources, the extreme voltages $V_O$ and $V_N$ are directly obtained (without impedance matching by an operational amplifier connected as a follower) from said terminals. In the case of a linear distribution of the voltages, the resistances R1–RN will all have the same value, otherwise their ratio will be calculated as a function of the desired values $V_O$ to $V_N$.

Figure 7:
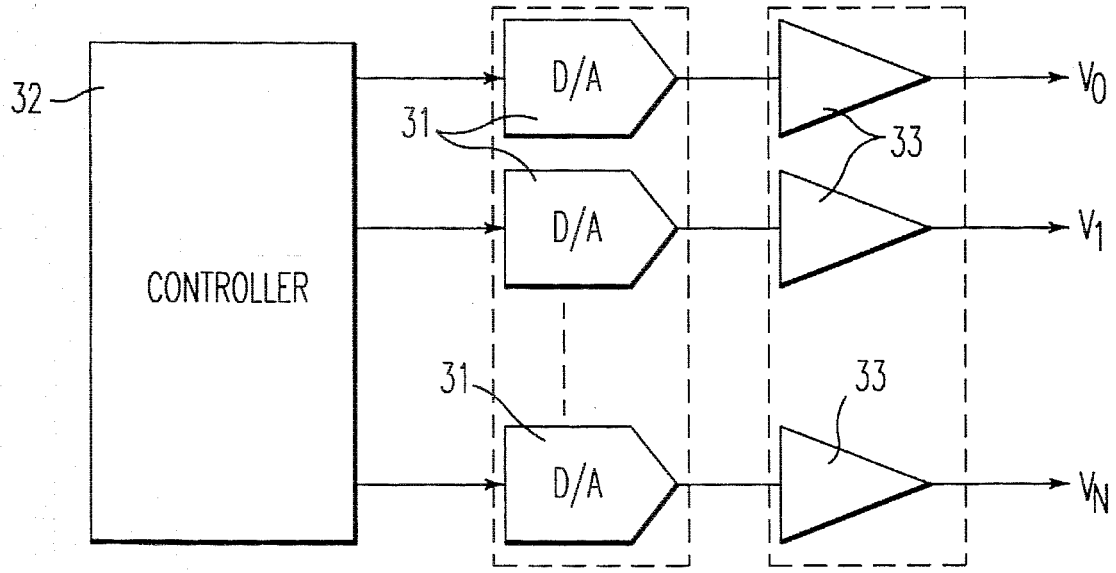

However, this generator of N+1 discrete voltages can also be constructed, as shown in FIG. 7, on the basis of one or more digital-analog converters 31, which are driven by a controller 32 responsible for calculating the values of the N+1 voltages and followed by amplifiers 33.

In cathode ray tube applications, it is generally possible to choose to display a certain number of colors (or grey levels for a black and white display) chosen from among a much larger number, said functionality generally being fulfilled by a specific so-called palette circuit. This operation is possible within the scope of the invention and the palette circuit must then control the discrete voltage generator and therefore the palette in accordance with the requirements of the user.

Compared with EP-A-478 386, it should be noted that in the implementation of the device according to the invention the need to have equal time intervals leads to a simplification, because the switching times are perfectly defined and are not dependent on any external parameter. Thus, it is possible to use a simple CPG row subtime counter and operate by comparison between the state of the counter and all the bits constituting the low order of the data to be displayed. In EP-A-478 386 the subtimes (signals TM) are externally supplied, because the position of the tripping of the passage from Vi to Vi+1 is dependent on the characteristics of the display to be controlled (the time constant $R_s \times C_s$ e.g. varying with the display size).

We claim:

1. Process for the control of a microtip fluorescent display formed from pixels arranged in accordance with L rows and M columns which can have a discrete number of Q grey tones, said process comprising, at each selection of a row of the display during a row selection time $T_L$, the simultaneous application to the display columns of voltages corresponding to the grey levels to be displayed at the pixels corresponding to the intersection of said row and said columns, wherein the different column voltage values applicable to the columns are chosen in a strictly increasing sequence of N+1 values such that the row selection time is subdivided into S equal time intervals Δt, each voltage value being applied an integral number of time Δt, (N×S)+1 representing the number Q of grey levels, with N≧2 and S≧2, and in that during the row selection $T_L$ and as a function of the grey level to be displayed at a pixel, the corresponding column voltage assumes a first value Va for a certain number of time intervals Δt, during the remaining time intervals at the most one second value Vb, said second value following on to the first in the sequence of N voltages.

2. Device for controlling the columns of a microtip fluorescent display making it possible to display grey levels according to claim 1 comprising a digital data source supplying words K encoding the information to be displayed on k bits, a display controller receiving synchronization signals from the data source and controlling the different signals able to drive the control circuits of the display columns, a generator of (N+1) discrete voltages, the control circuits for the display columns incorporating a shift register with k inputs and k×M outputs, each output being associated with a storage flip-flop and analog multiplexing means connected on the one hand to the k×M flip-flops and to the generator and on the other to the M columns, said means making it possible to switch to each column a voltage chosen from among N+1 as a function of the word K stored in the k flip-flops associated with said column.

3. Device according to claim 2, wherein each word K stored in the k flip-flops of a control circuit of a column is subdivided into two words H and B such that the word H is constituted by the h most significant bits of K with $2^h$=N+1 and such that the word B is constituted by the (k−h) remaining least significant bits, the multiplexing means of the control circuit of a column comprising a binary decoding circuit of n bits 1 from among $2^n$ connected to the h flip-flops of said column having in the memory the h most significant bits, said circuit producing N signals $H_0$ to $H_{N-1}$ translating the coding of H and making it possible to select the pair of column voltages ($V_i$, $V_{i+1}$) adapted to the grey level to be displayed, a comparator connected to the (k−h) least significant bits and with a sequencer able to supply the addressing sequence within a row time coded on (k−h) bits, a combinatorial logic circuit connected to the outputs of the decoding circuit and to the comparator, N+1 analog switches, whose analog inputs are connected to the generator and the validation inputs to the combinatorial logic circuit and whereof all the outputs are connected to the corresponding column.

4. Device according to claim 3, wherein the sequencer is a counter, whose clock has $2^{(k-h)}$ pulses per row time, said counter being initialized for each row time.

5. Device according to claim 3, wherein the comparator performs the comparison between the signals P and B and supplies a coding bit E such that:

$$P<B \Rightarrow E=1$$

$$P \geqq B \Rightarrow E=0.$$

6. Device according to claim 3, wherein the combinatorial logic circuit between the coding bit E and the signals $H_0$ to $H_{N-1}$ makes it possible to obtain the signals $F_O$ to $F_N$, which drive the N+1 analog switches, such that:

$$F_0=\bar{E}\cdot H_0$$

$$F_1=E\cdot H_o+\bar{E}\cdot H_1$$

$$F_i=E\cdot H_{i-1}+\bar{E}\cdot H_i$$

$$F_{N-1}=E\cdot H_{N-2}+\bar{E}\cdot H_{N-1}$$

$$F_N=E\cdot H_{N-1}$$

so as to position in time the change of voltage Vi to Vi+1.

7. Device according to claim 2, wherein the generator of N+1 discrete voltages is constituted by operational amplifiers connected as follower amplifiers, with input voltages fixed by a resistive divider bridge.

8. Device according to claim 7, wherein in the case of a linear distribution of the voltages, the resistances of the divider bridge all have the same value.

9. Device according to claim 2, wherein the generator of N+1 discrete voltages is constructed on the basis of one or more digital-analog converters, themselves driven by a controller responsible for calculating the values of the N+1 voltages.

10. Device according to claim 2 comprising a black and white or color palette circuit making it possible to control the discrete voltage generator in accordance with the wishes of the user.

* * * * *